US007442135B2

(12) United States Patent
Giannetti et al.

(10) Patent No.: US 7,442,135 B2
(45) Date of Patent: Oct. 28, 2008

(54) BALL BAT INCLUDING A FOCUSED FLEXURE REGION

(75) Inventors: William B. Giannetti, Van Nuys, CA (US); Dewey Chauvin, Simi Valley, CA (US)

(73) Assignee: Easton Sports, Inc., Van Nuys, CA (US)

( * ) Notice: Subject to any disclaimer, the term of this patent is extended or adjusted under 35 U.S.C. 154(b) by 0 days.

(21) Appl. No.: 11/188,146

(22) Filed: Jul. 22, 2005

(65) Prior Publication Data

US 2006/0025252 A1 Feb. 2, 2006

Related U.S. Application Data

(63) Continuation-in-part of application No. 11/152,036, filed on Jun. 14, 2005, which is a continuation-in-part of application No. 11/078,782, filed on Mar. 11, 2005, which is a continuation-in-part of application No. 10/903,493, filed on Jul. 29, 2004, said application No. 11/152,036 and a continuation-in-part of application No. 11/034,993, filed on Jan. 12, 2005, is a continuation-in-part of application No. 10/903,493, filed on Jul. 29, 2004.

(51) Int. Cl.
*A63B 59/06* (2006.01)

(52) U.S. Cl. ..... 473/567; 473/520

(58) Field of Classification Search ..... 473/564–568, 473/457, 519, 520

See application file for complete search history.

(56) References Cited

U.S. PATENT DOCUMENTS

| | | | |
|---|---|---|---|
| 1,611,858 | A | 12/1926 | Middlekauff |
| 2,031,161 | A | 2/1936 | Hamel |
| 4,848,745 | A | 7/1989 | Bohannan et al. |
| 4,931,247 | A | 6/1990 | Yeh |
| 4,940,247 | A | 7/1990 | Magadini |
| 5,131,651 | A | 7/1992 | You |
| 5,301,940 | A | 4/1994 | Seki et al. |
| 5,303,917 | A | 4/1994 | Uke |
| 5,362,046 | A | 11/1994 | Sims |
| 5,364,095 | A | 11/1994 | Easton et al. |
| 5,380,003 | A | 1/1995 | Lanctot |
| 5,395,108 | A | 3/1995 | Souders et al. |
| 5,415,398 | A | 5/1995 | Eggiman |

(Continued)

OTHER PUBLICATIONS

Reynolds, et al., "Hand-Arm Vibration, Part III: Subjective Response Characteristics of Individuals to Hand-Induced Vibrations," *Journal of Sound and Vibration*, 51(2): 267-282 (1977).

(Continued)

*Primary Examiner*—Mark S Graham
(74) *Attorney, Agent, or Firm*—Perkins Coie LLP

(57) ABSTRACT

A ball bat includes one or more focused flexure regions located predominantly or entirely in the transition section between the barrel and the handle of the ball bat. One or more of the focused flexure regions may additionally or alternatively be located partially or entirely in the barrel and/or the handle of the ball bat. The one or more focused flexure regions each include a radially inner structural region and a radially outer dampening region for reducing the local axial stiffness, and improving the flexure, of the ball bat at the location of the focused flexure region.

21 Claims, 1 Drawing Sheet

U.S. PATENT DOCUMENTS 5,482,270 A 1/1996 Smith
5,511,777 A 4/1996 McNeely
5,516,097 A 5/1996 Huddleston
5,593,158 A * 1/1997 Filice et al. ..... 473/520
5,624,115 A 4/1997 Baum
5,676,610 A 10/1997 Bhatt et al.
5,711,728 A 1/1998 Marcelo
5,759,113 A 6/1998 Lai et al.
5,772,541 A 6/1998 Buiatti
5,833,561 A 11/1998 Kennedy et al.
5,899,823 A 5/1999 Eggiman
5,964,673 A 10/1999 MacKay, Jr.
6,007,439 A 12/1999 MacKay, Jr.
6,022,282 A 2/2000 Kennedy et al.
6,042,493 A 3/2000 Chauvin et al.
6,053,828 A 4/2000 Pitsenberger
6,086,490 A 7/2000 Spangler et al.
6,176,795 B1 1/2001 Schullstrom
6,344,007 B1 2/2002 Feeney et al.
6,352,485 B1 3/2002 Philpot et al.
6,383,101 B2 5/2002 Eggiman et al.
6,398,675 B1 6/2002 Eggiman et al.
6,425,836 B1 7/2002 Misono et al.
6,440,017 B1 8/2002 Anderson
6,461,260 B1 10/2002 Higginbotham
6,497,631 B1 12/2002 Fritzke et al.
6,508,731 B1 1/2003 Feeney et al.
6,663,517 B2 12/2003 Buiatti et al.
6,709,352 B1 3/2004 Albin
6,723,012 B1 4/2004 Sutherland
6,729,983 B1 5/2004 Vakili et al.
6,733,404 B2 5/2004 Fritzke et al.
6,761,653 B1 7/2004 Higginbotham et al.
6,764,419 B1 7/2004 Giannetti et al.
6,776,735 B1 8/2004 Belanger
6,863,628 B1 3/2005 Brandt
6,866,598 B2 3/2005 Giannetti et al.
6,869,372 B1 3/2005 Higginbotham et al.
2001/0014634 A1 8/2001 MacKay, III
2002/0151392 A1 10/2002 Buiatti et al.
2002/0198071 A1 12/2002 Snow
2003/0004020 A1 * 1/2003 Ogawa et al. ..... 473/564
2003/0195066 A1 10/2003 Eggiman et al.
2004/0077439 A1 4/2004 Eggiman et al.
2004/0176197 A1 9/2004 Sutherland
2005/0070384 A1 3/2005 Fitzgerald et al.
2005/0143203 A1 6/2005 Souders et al.
2005/0227795 A1 10/2005 Fritzke

OTHER PUBLICATIONS

Belknap, "Vibration Suppression of Thin-Walled Composite Tubes Using Embedded Viscoelastic Layers," *Proceedings of Damping*, Feb. 13-15, San Diego, CA (1991).

Mustone, et al., "Using LS-DYNA to Develop a Baseball Bat Performance and Design Tool," 6th International LS-DYNA Users Conference, Apr. 9-10, Detroit, MI.

Combined International Search Report and Written Opinion of the International Searching Authority for International Application No. PCT/US05/26872; issued by the ISA/US;dated Dec. 5, 2005.

* cited by examiner

BALL BAT INCLUDING A FOCUSED FLEXURE REGION

This application is a Continuation-In-Part of U.S. patent application Ser. No. 11/152,036, filed Jun. 14, 2005, which is a Continuation-In-Part of U.S. patent application Ser. No. 11/078,782, filed Mar. 11, 2005, which is a Continuation-In-Part of U.S. patent application Ser. No. 10/903,493, filed Jul. 29, 2004. U.S. patent application Ser. No. 11/152,036 is also a Continuation-In-Part of U.S. patent application Ser. No. 11/034,993, filed Jan. 12, 2005, which is a Continuation-In-Part of U.S. patent application Ser. No. 10/903,493, filed Jul. 29, 2004. Priority is claimed to each of the above-listed patent applications, which are incorporated herein by reference.

BACKGROUND

During a typical bat swing, energy is stored in the bat in the form of kinetic and potential energy. The kinetic energy is stored in the form of momentum, and the potential energy is stored in the form of axial bat deformation resulting from acceleration of the bat mass. This deformation is similar to that which occurs when a spring is compressed. When the spring is released, the potential energy is converted back to kinetic energy and therefore adds an acceleration component to the bat prior, most preferably just prior, to contact with the ball. The timing of the release of this energy is important to bat design, and is related to the "kick point" of the bat. The kick point is the point of maximum curvature in the ball bat resulting from inertia that occurs during rotation of the bat.

Low kick point bats (i.e., bats where bending occurs just above the hands) can deliver high energy but are often prone to lagging, and as a result, poor general bat performance. For example, players will tend to foul pitches off or hit balls weakly to the opposite field when using low kick point bats. High kick point bats (i.e., bats where bending occurs closer to the barrel) often lack sufficient recoil energy to be effective, since typical bat diameters at this location are relatively large, and such bats are therefore very stiff in this region. Thus, a need exits for a bat that exhibits improved flexure and kick point characteristics.

SUMMARY

A ball bat includes one or more focused flexure regions located predominantly or entirely in the transition section between the barrel and the handle of the ball bat. One or more of the focused flexure regions may additionally or alternatively be located partially or entirely in the barrel and/or the handle of the ball bat. The one or more focused flexure regions each include a radially inner structural region and a radially outer dampening region for reducing the local axial stiffness, and improving the flexure, of the ball bat at the location of the focused flexure region.

Other features and advantages of the invention will appear hereinafter. The features of the invention described above can be used separately or together, or in various combinations of one or more of them. The invention resides as well in subcombinations of the features described.

BRIEF DESCRIPTION OF THE DRAWINGS

In the drawings, wherein the same reference number indicates the same element throughout each of the views.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Figure 1:
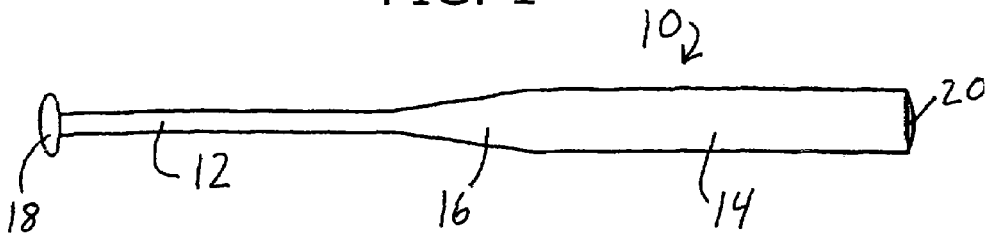
FIG. 1 is a side view of a ball bat.

Turning now in detail to the drawings, as shown in FIG. 1, a baseball or softball bat 10, hereinafter collectively referred to as a "ball bat" or "bat," includes a handle 12, a barrel 14, and a transition region or tapered section 16 joining the handle 12 to the barrel 14. The free end of the handle 12 includes a knob 18 or similar structure. The barrel 14 is preferably closed off by a suitable cap, plug, or other end closure 20. The interior of the bat 10 is preferably hollow, which facilitates the bat 10 being relatively lightweight so that ball players may generate substantial bat speed when swinging the bat 10.

The ball bat 10 preferably has an overall length of 20 to 40 inches, or 26 to 34 inches. The overall barrel diameter is preferably 2.0 to 3.0 inches, or 2.25 to 2.75 inches. Typical bats have diameters of 2.25, 2.625, or 2.75 inches. Bats having various combinations of these overall lengths and barrel diameters, as well as any other suitable dimensions, are contemplated herein. The specific preferred combination of bat dimensions is generally dictated by the user of the bat 10, and may vary greatly between users.

The bat barrel 14 may be a single-wall or a multi-wall structure. If it is a multi-wall structure, the barrel walls may optionally be separated by one or more interface shear control zones (ISCZs), as described in detail in incorporated U.S. patent application Ser. No. 10/903,493. Any ISCZ used preferably has a radial thickness of approximately 0.001 to 0.010 inches, or 0.005 to 0.006 inches. Any other suitable size ISCZ may alternatively be used.

An ISCZ may include a bond-inhibiting layer, a friction joint, a sliding joint, an elastomeric joint, an interface between two dissimilar materials (e.g., aluminum and a composite material), or any other suitable element or means for separating the barrel into "multiple walls." If a bond-inhibiting layer is used, it is preferably made of a fluoropolymer material, such as Teflon® (polyfluoroethylene), FEP (fluorinated ethylene propylene), ETFE (ethylene tetrafluoroethylene), PCTFE (polychlorotrifluoroethylene), or PVF (polyvinyl fluoride), and/or another suitable material, such as PMP (polymethylpentene), nylon (polyamide), or cellophane.

In one embodiment, one or more ISCZs may be integral with, or embedded within, layers of barrel material, such that the barrel 14 essentially acts as a one-piece/multi-wall construction. In such a case, the barrel layers at at least one end of the barrel are preferably blended together to form the one-piece/multi-wall construction. The entire ball bat 10 may also be formed as "one piece." A one-piece bat design, as used herein, generally refers to the barrel 14, the tapered section 16, and the handle 12 of the ball bat 10 having no gaps, inserts, jackets, or bonded structures that act to appreciably thicken the barrel wall(s). In such a design, the distinct laminate layers are preferably integral to the barrel structure so that they all act in unison under loading conditions. To accomplish this one-piece design, the layers of the bat 10 are preferably co-cured, and are therefore not made up of a series of connected tubes (e.g., inserts or jackets) that each have a separate wall thickness at the ends of the tubes.

The blending of the barrel walls into a one-piece construction, around one or more ISCZs, like tying the ends of a leaf spring together, offers a stable, durable assembly, especially for when impact occurs at the extreme ends of the barrel 14. Bringing multiple laminate layers together assures that the system acts as a unitized structure, with no one layer working independent of the others. By redistributing stresses to the extreme ends of the barrel, local stresses are reduced, resulting in increased bat durability.

The one or more structural barrel walls or "tubes," as well as the handle 12 and transition region 16, are preferably predominantly or entirely made up of one or more composite plies. The composite materials that make up the plies are preferably fiber-reinforced, and may include fibers of glass, graphite, boron, carbon, aramid (e.g., Kevlar®), ceramic, metallic, and/or any other suitable structural fibrous materials, preferably in epoxy form or another suitable form. Each composite ply preferably has a thickness of approximately 0.002 to 0.060 inches, or 0.005 to 0.008 inches. Any other suitable ply thickness may alternatively be used.

In one embodiment, the bat barrel 14 may comprise a hybrid metallic-composite structure. For example, the barrel may include one or more walls made of composite material (s), and one or more walls made of metallic material(s). Alternatively, composite and metallic materials may be interspersed within a given barrel wall. In another embodiment, nano-tubes, such as high-strength carbon nano-tube composite structures, may alternatively or additionally be used in the barrel construction.

Figure 2:
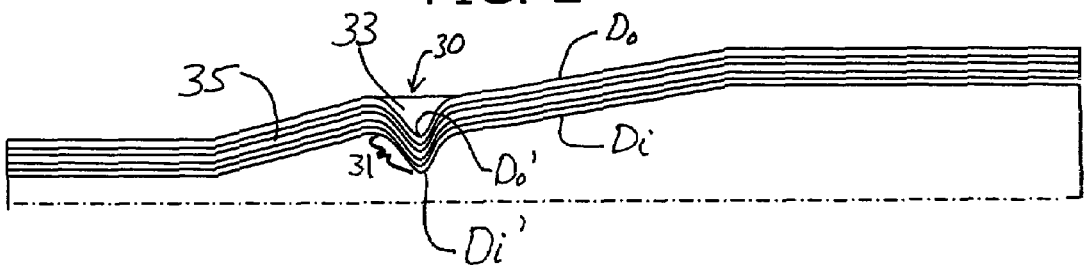
FIG. 2 is a side-sectional view of a ball bat including a focused flexure region, according to one embodiment.

FIG. 2 illustrates one embodiment of a ball bat 10 including a focused flexure region 30. The focused flexure region 30 includes a radially inner region 31 comprising one or more structural composite materials, such as those described above, and a radially outer region 33 comprising one or more "non-structural" materials having a lower axial elastic modulus than the neighboring structural composite materials in the ball bat 10. The focused flexure region 30 is preferably located predominantly or entirely in the transition region 16 of the ball bat, but it may alternatively or additionally be located partially or completely in the handle 12 and/or the barrel 14 of the ball bat 10. Furthermore, more than one focused flexure region 30 may be included in the ball bat 10.

The radially inner structural region 31 of the focused flexure region 30 may be continuous with the neighboring structural materials 35 in the ball bat 10 or may be a separate region with defined beginning and/or ending locations. The thickness of the radially inner region 31 may be substantially equal to the thickness of the structural materials or layers 35 in the neighboring regions, including throughout the handle, the barrel, and/or the transition section (i.e., the structural "tube" may have a relatively uniform thickness throughout the ball bat 10), or the thickness of the radially inner region 31 may vary relative to one or more of the other structural regions in the ball bat 10.

By including the "indented" focused flexure region 30, the outer and inner diameters of the structural layers or material (s), or structural "tube," in the radially inner region 31 are reduced relative to the outer and inner diameters of neighboring structural regions 35 in the ball bat 10. The structural axial stiffness in bending (EI) of a material region, at a given longitudinal location of the ball bat 10, is a function of the outer diameter of the material region, $D_0$, the material thickness, $(D_0\text{-}D_i)$, and the material axial elastic modulus, E, as governed by the following equation:

$$\text{Tube Structural Stiffness in Bending} = EI = \frac{\pi E}{64}(D_0^4 - D_i^4)$$

In the drawings, the reference symbols $D_0$, $D_0'$, $D_i$, and $D_i'$ indicate locations in the ball bat 10 to which the respective diameters are measured. For example, $D_0$ refers to a location to which the outer diameter of the ball bat 10 is measured. $D_i$ refers to a location to which the inner diameter of the wall(s) or tube(s) of the ball bat 10, at any region except for the focused flexure region 30, is measured. Thus, $D_0$ and $D_i$ typically vary between and/or within the handle 12, the transition section 16, and/or the barrel 14. $D_0'$ and $D_i'$ refer to locations in the ball bat 10 to which outer and inner diameters, respectively, of the radially inner region 31 of the focused flexure region 30 are measured.

By reducing the outer diameter $D_0'$ (relative to $D_0$) of the structural material in the radially inner region 31 of the focused flexure region 30, the axial stiffness of the structural "tube" is significantly reduced at that location relative to neighboring regions in the ball bat 10. As a result, the focused flexure region 30 generally coincides with the "kick point" of the ball bat 10. The kick point refers to the point of maximum curvature in the ball bat 10 resulting from inertia that occurs during rotation of the bat 10.

One possible location for the focused flexure region 30 is in the transition section 16, near the primary fundamental vibration anti-node of the ball bat 10. Generally, this location is at or near the end of the handle 12 just as the outer bat diameter ($D_0$) starts to increase. This region is subjected to the highest axial deflection during a swing and, as a result, can be tuned to a player's specific swing style by utilizing the natural tendency of the bat 10 to bend in this specific area. Some advantages to this location are that the outer diameter ($D_0$) of a typical ball bat 10 is not so large at this location that it significantly increases the sectional stiffness, and that there is enough barrel mass beyond this section for the inertial load during the bat swing acceleration to cause the bat to bend. Additionally, ball impacts are typically rare in this location, so bat durability should not be significantly adversely affected by making the bat axially flexible in this location.

For a specific homogeneous material, such as aluminum ($E=10^6$ psi), for example, the bending stiffness of a wall or structural tube having an outer diameter $D_0$ of 1.50 inches and a thickness $(D_0\text{-}D_i)$ of 0.10 inches is approximately 235% greater (i.e., 2.35 times stiffer) than an identical thickness wall or tube having an outer diameter $D_0'$ of 1.15 inches. Accordingly, it requires approximately 2.35 times the load to bend the 1.50 inch diameter tube to the same deflection as the 1.15 inch diameter tube. Put another way, for a fixed energy swing, a 1.15 inch diameter structural region of a ball bat 10 will deflect and rebound with approximately 235% more potential energy than will a 1.50 inch diameter structural region (the actual difference will vary depending upon the material properties of the radially outer region 33 of the focused flexure region 30).

Thus, by making minimal changes to the local diameter ($D_0'$) of the structural material in the radially inner region 31 of the focused flexure region 30, the local axial stiffness and flexibility of the ball bat 10 may be significantly reduced or otherwise altered. To achieve the desired effect of these diameter changes in the focused flexure region 30, the radially outer region 33 of the focused flexure region 30 is preferably made up of one or more materials having a lower axial elastic modulus than the axial elastic modulus/moduli of the one or more neighboring structural materials 35 in the ball bat 10.

These lower axial elastic modulus materials, referred to herein as "dampening materials," may include one or more viscoelastic and/or elastomeric materials, such as elastomeric rubber, silicone, gel foam, or other similar materials that have relatively low axial elastic moduli. Any other material(s) having a lower elastic modulus than the neighboring structural materials 35 in the ball bat may alternatively or additionally be used in the radially outer region 33, including, but not limited to, PBO (polybenzoxazole), UHMWPE (ultra high molecular weight polyethylene, e.g., Dyneema®), fiberglass, dacron® ("polyethylene terephthalate"-PET or PETE), nylon® (polyamide), certran®, Pentex®, Zylon®, Vectran®, and/or aramid.

Thus, depending on the one or more materials that are used to form the structural layers 35 of the ball bat 10, a wide variety of dampening materials (relative to the neighboring or surrounding structural materials 35) may be used in the radially outer region 33 of the focused flexure region 30. For example, a soft rubber dampening material may have an axial elastic modulus of approximately 10,000 psi, whereas a "dampening" material such as aramid may have an axial elastic modulus of approximately 12,000,000 psi. While the axial elastic modulus of aramid is significantly greater than that of a typical soft rubber material, aramid may still have an appreciable dampening effect on surrounding or neighboring structural bat material(s) having an even higher axial elastic modulus, and it may provide increased durability relative to softer materials. Accordingly, materials having a relatively high axial elastic modulus, such as aramid, may be used as effective dampeners in some ball bat constructions.

Figure 3:
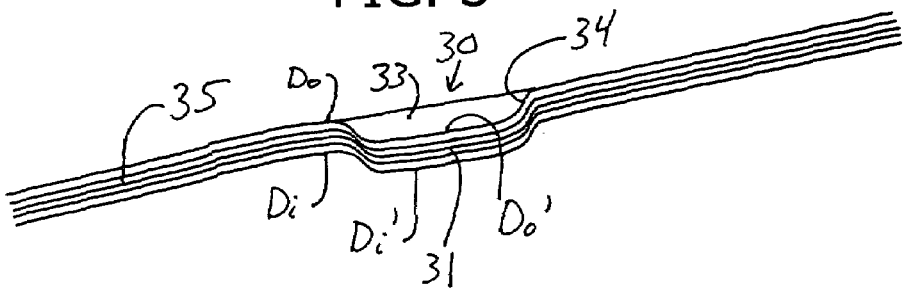
FIG. 3 is a close up side-sectional view of the transition region of a ball bat including a focused flexure region, according to another embodiment.

FIG. 3 illustrates one possible configuration of the focused flexure region 30, although any other shape or configuration suitable for providing reduced axial stiffness in the focused flexure region 30 may alternatively be used. The radially outer region 33 of the focused flexure region 30 preferably has a depth (approximately equal to $D_0$-$D_0'$) of approximately 0.060 to 0.250 inches, or 0.080 to 0.120 inches. Any other depth may alternatively be used. If an ISCZ or similar region is included in the ball bat 10 (in a multi-wall bat, for example), the radially outer region 33 may optionally have a depth extending up to (or passing through an opening in) the ISCZ.

The base of the radially outer region 33 preferably has a length of 0.20 to 1.50 inches, or 0.40 to 0.80 inches, and the outer surface (corresponding to the outer surface of the ball bat 10) of the radially outer region 33 preferably has a length of approximately 0.25 to 2.50 inches, or 0.50 to 1.50 inches. The radially outer region 33 may have any other suitable dimensions, and may or may not have tapered end regions 34 (as shown in FIG. 3, for example).

In one embodiment, the depth of the radially outer region 33 is 60% to 150%, or 80% to 120%, of the thickness of the radially inner region 31. Additionally or alternatively, the outer diameter $D_0'$ of the radially inner region 31 is 60% to 95%, or 70% to 85%, of the outer diameter $D_0$ of the neighboring longitudinal regions in the ball bat 10. Additionally or alternatively, the focused flexure region 30 has an axial stiffness that is 10% to 90%, or 30% to 70%, or 40% to 60%, of the axial stiffness of the neighboring longitudinal regions of the ball bat. This reduced axial stiffness may be the result of the material in the radially outer region 33 having a lower axial elastic modulus than neighboring regions in the ball bat 10 and/or from the radially inner region 31 having a smaller outer diameter $D_0'$ and/or thickness ($D_0'$-$D_i'$) than neighboring longitudinal regions in the ball bat 10. One or more of these relative percentages may vary beyond the limits described herein, depending on the dictates of a given bat design.

The location, shape, and configuration of the one or more focused flexure regions 30 may vary based upon the structural requirements of a given ball bat 10. By locating a focused flexure region 30 in the transition section 16, for example, bat flexure can be increased and vibrational energy can be attenuated from the bat structure, thus increasing barrel performance kinetics. The axial stiffness and location of the focused flexure region 30 can be tuned to provide specific recoil for varying styles of batting (e.g., push or snap styles). The focused flexure region 30 may, for example, be located closer to the barrel 14 in a typical baseball bat, or closer to the handle 12 in a typical fast pitch softball bat.

In general, a focused flexure region 30 may be positioned in the tapered section 16 toward the barrel 14 to provide increased "snap-back" during a swing, whereas it may be positioned in the tapered section 16 toward the handle 12 to provide less snap-back for players who tend to "push" the bat during a swing. Thus, depending on the requirements of a given bat design, one or more focused flexure regions 30 may be positioned in any suitable location within the bat structure.

The ball bat 10 may be constructed in any suitable manner. In one embodiment, the ball bat 10 is constructed by rolling the various layers of the bat 10 onto a mandrel or similar structure having the desired bat shape. The one or more focused flexure regions 30, as well as any ISCZs, if used, are preferably strategically placed, located, and/or oriented, as shown and described above. The one or more focused flexure regions 30 are preferably located predominantly or entirely in the tapered section 16 of the ball bat 10, but may additionally or alternatively be included partially or entirely in the handle 12 and/or the barrel 14 of the ball bat 10 to provide increased flexure and attenuation of vibrational energy in those regions.

The ends of the material layers are preferably "clocked," or offset, from one another so that they do not all terminate at the same location before curing. Additionally, if varying layer orientations and/or wall thicknesses are used, the layers may be staggered, feathered, or otherwise angled or manipulated to form the desired bat shape. Accordingly, when heat and pressure are applied to cure the bat 10, the various layers blend together into a distinctive "one-piece," or integral, construction. Furthermore, during heating and curing of the composite layers, the dampening material in the radially outer region 33 of the one or more focused flexure regions 30 preferably fuses with the neighboring composite material and becomes an integral part of the overall bat structure.

Put another way, all of the layers of the bat are "co-cured" in a single step, and blend or terminate together at at least one end, resulting in a single-piece structure with no gaps (at the at least one end), such that the barrel 14 is not made up of a series of tubes each with a separate wall thickness that terminates at the ends of the tubes. As a result, all of the layers act in unison under loading conditions, such as during striking of a ball. One or both ends of the barrel 14 may terminate together in this manner to form a one-piece barrel 14, including one or more barrel walls (depending on whether any ISCZs are used). In an alternative design, neither end of the barrel is blended together, such that a multi-piece construction is formed.

The described bat construction, incorporating one or more focused flexure regions 30, increases bat flexure and decreases the vibrational energy transmitted to the bat handle and the batter's hands. Accordingly, the feel of the bat may be improved for a given batter, and sting felt by the batter may be significantly reduced or eliminated.

Thus, while several embodiments have been shown and described, various changes and substitutions may of course be made, without departing from the spirit and scope of the invention. The invention, therefore, should not be limited, except by the following claims and their equivalents.

What is claimed is:

1. A one-piece ball bat, comprising:

a handle comprising a first structural material;

a barrel comprising a second structural material; and a transition section continuous with the barrel and the handle to form the one-piece ball bat, with at least a portion of the transition section including:

a radially innermost region comprising a third structural material and being devoid of slits and perforations, and a radially outermost region abutting the third structural material, with the radially outermost region devoid of slits and perforations and comprising a dampening material having a lower axial elastic modulus than that of at least one of the first, second, and third structural materials, wherein the dampening material has a radially outer surface that is continuous with radially outer surfaces of longitudinally neighboring structural regions in the ball bat.

2. The ball bat of claim 1 wherein the dampening material comprises at least one of a viscoelastic and an elastomeric material.

3. The ball bat of claim 1 wherein the radially outermost region has a depth of 0.060 to 0.250 inches.

4. The ball bat of claim 1 wherein the radially outermost region has a depth of 0.080 to 0.120 inches.

5. The ball bat of claim 1 wherein a longitudinal region of the ball bat including the dampening material has an axial stiffness that is 30% to 70% of the axial stiffness of longitudinally neighboring regions of the ball bat.

6. The ball bat of claim 1 wherein a depth of the radially outermost region is 80% to 120% of a thickness of the radially inner region.

7. The ball bat of claim 1 wherein an outer diameter of the radially inner region is 70% to 85% of an outer diameter of longitudinally neighboring structural regions in the ball bat.

8. The ball bat of claim 1 wherein a thickness of the first, second, and third structural materials is approximately constant throughout the handle, the barrel, and the transition section.

9. The ball bat of claim 1 wherein an outer surface of the radially outermost region has a length of 0.5 to 1.5 inches.

10. The ball bat of claim 1 wherein the dampening material extends partially into at least one of the barrel and the handle.

11. The ball bat of claim 1 wherein the first, second, and third structural materials all comprise the same material.

12. The ball bat of claim 1 wherein the radially outermost region has a lower axial elastic modulus than each of the first, second, and third structural materials.

13. A one-piece ball bat including a barrel, a handle, and a transition section joining the barrel and the handle, each comprising at least one structural material, the ball bat comprising:

a focused flexure region devoid of cut fibers and located in at least one of the handle and the transition section, with the focused flexure region including:

a radially outermost region comprising a dampening material having a lower axial elastic modulus than that of the at least one structural material, wherein no portion of the dampening material is located radially between structural regions of the ball bat and wherein the dampening material has a radially outer surface that is continuous with radially outer surfaces of longitudinally neighboring structural regions in the ball bat; and a radially inner structural region abutting the radially outermost region and having smaller outer and inner diameters than, and approximately the same radial thickness as, longitudinally neighboring structural regions in the ball bat.

14. The ball bat of claim 13 wherein the radially outermost region has a depth of 0.080 to 0.120 inches.

15. The ball bat of claim 13 wherein the focused flexure region has an axial stiffness that is 30% to 70% of the axial stiffness of longitudinally neighboring regions of the ball bat.

16. The ball bat of claim 13 wherein a depth of the radially outermost region is 80% to 120% of a thickness of the radially inner structural region.

17. The ball bat of claim 13 wherein an outer diameter of the radially inner structural region is 70% to 85% of an outer diameter of the longitudinally neighboring structural regions in the ball bat.

18. The ball bat of claim 13 wherein the dampening material is located predominantly or entirely in the transition section of the ball bat.

19. The ball bat of claim 18 wherein the dampening material extends partially into at least one of the barrel and the handle of the ball bat.

20. A one-piece ball bat including a barrel, a handle, and a transition section joining the barrel and the handle, comprising:

a flexure region in at least one of the handle and the transition section including:

a radially innermost region comprising a structural composite material devoid of cut fibers, and a radially outermost region abutting the radially innermost region, with the radially outermost region comprising a dampening material devoid of cuts, wherein the dampening material has a radially outer surface that is continuous with radially outer surfaces of longitudinally neighboring structural regions in the ball bat.

21. The ball bat of claim 20 wherein the dampening material has a lower axial elastic modulus than that of surrounding structural materials in the ball bat, and the structural region has a smaller outer diameter than that of longitudinally neighboring structural regions in the ball bat.

* * * * *